US006333083B1

(12) United States Patent
Smedley et al.

(10) Patent No.: US 6,333,083 B1
(45) Date of Patent: Dec. 25, 2001

(54) FOLDABLE ARTIFICIAL CHRISTMAS TREE

(76) Inventors: Rick Smedley; Donald Smedley, both of 7042 State Rd. 350 West, Clarksville, OH (US) 45113

( * ) Notice: Subject to any disclaimer, the term of this patent is extended or adjusted under 35 U.S.C. 154(b) by 0 days.

(21) Appl. No.: 09/546,009

(22) Filed: Apr. 8, 2000

(51) Int. Cl.[7] ..... A47G 33/06
(52) U.S. Cl. ..... 428/8; 428/20; 428/66.6
(58) Field of Search ..... 428/64.1, 66.6, 428/20, 8; 211/205

(56) References Cited

U.S. PATENT DOCUMENTS 4,451,510 * 5/1984 Boisvert et al. ..... 428/20
5,150,874 * 9/1992 Spiegel et al. ..... 428/8

* cited by examiner

*Primary Examiner*—Alexander S. Thomas
(74) *Attorney, Agent, or Firm*—Goldstein Law Offices P.C.

(57) ABSTRACT

A foldable artificial Christmas tree including a plurality of sections couplable together to form a Christmas tree. Each of the sections includes a central pole portion. A plurality of collars are provided that each have a central opening for receiving the central pole portion therein. Each of the collars has a generally circular configuration. The collars each have an outer periphery. Each of the collars has a plurality of radially extending apertures disposed within the outer periphery thereof in a spaced relationship. A plurality of branches are foldably coupled with the plurality of collars. Each of the branches has a limb portion. The limb portion has an inner portion and an outer portion. The outer portion has a plurality of artificial pine needles extending outwardly therefrom. The inner portion has a downwardly turned portion secured thereto. The downwardly turned portion is receivable within the radially extending apertures of the collars.

1 Claim, 3 Drawing Sheets

FIG. 3
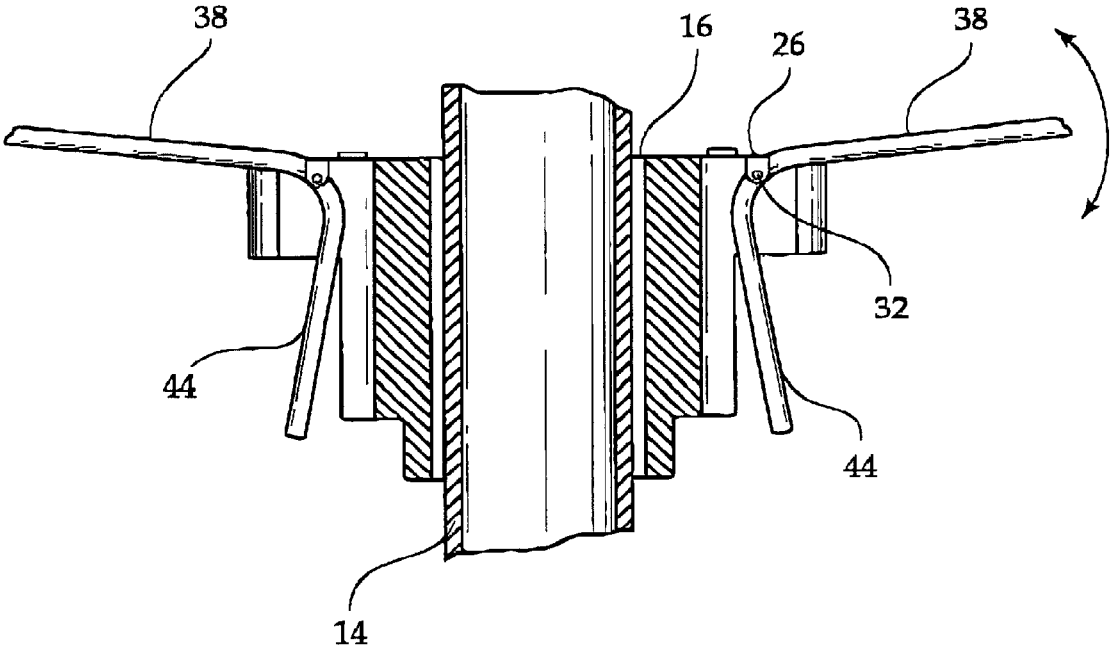
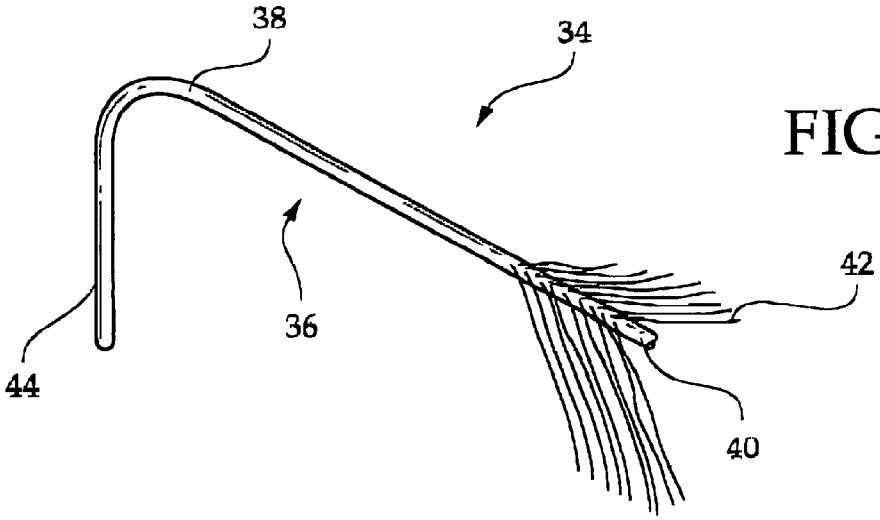
FIG. 4

FOLDABLE ARTIFICIAL CHRISTMAS TREE

BACKGROUND OF THE INVENTION

The present invention relates to a foldable artificial Christmas tree and more particularly pertains to allowing for quick and easy assembly and disassembly.

The use of artificial Christmas trees is known in the prior art. More specifically, artificial Christmas trees heretofore devised and utilized for the purpose of simulating real Christmas trees are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,928,689 to Mottel discloses an artificial tree with branches hinged around the circumference of the trunk using a collar assembly. U.S. Pat. No. 4,109,345 to Sargent discloses a hinge assembly for holding the branches of an artificial Christmas tree. U.S. Pat. No. 4,172,913 to Ballah discloses an artificial Christmas tree with a hinge assembly for extending the branches from the base.

While these devices fulfill their respective, particular objective and requirements, the aforementioned patents do not describe a foldable artificial Christmas tree for allowing for quick and easy assembly and disassembly.

In this respect, the foldable artificial Christmas tree according to the present invention substantially departs from the conventional concepts and designs of the prior art, and in doing so provides an apparatus primarily developed for the purpose of allowing for quick and easy assembly and disassembly.

Therefore, it can be appreciated that there exists a continuing need for a new and improved foldable artificial Christmas tree which can be used for allowing for quick and easy assembly and disassembly. In this regard, the present invention substantially fulfills this need.

SUMMARY OF THE INVENTION

In the view of the foregoing disadvantages inherent in the known types of artificial Christmas trees now present in the prior art, the present invention provides an improved foldable artificial Christmas tree. As such, the general purpose of the present invention, which will be described subsequently in greater detail, is to provide a new and improved foldable artificial Christmas tree which has all the advantages of the prior art and none of the disadvantages.

To attain this, the present invention essentially comprises a plurality of sections couplable together to form a Christmas tree. Each of the sections includes a central pole portion. A plurality of collars are provided that each have a central opening for receiving the central pole section therein. Each of the collars has a generally circular configuration. The collars each have an outer periphery. Each of the collars has a plurality of radially extending apertures disposed within the outer periphery thereof in a spaced relationship. Each of the radially extending apertures has opposed side walls. The opposed side walls have an inverted U-shaped bracket secured therebetween. The bracket includes an upper horizontal segment and a pair of opposed vertical segments. The opposed vertical segments have a support bar extending therebetween whereby the support bar is parallel with the upper horizontal segment. A plurality of branches are foldably coupled with the plurality of collars. Each of the branches has a limb portion. The limb portion has an inner portion and an outer portion. The outer portion has a plurality of artificial pine needles extending outwardly therefrom. The inner portion has a downwardly turned portion secured thereto.

The downwardly turned portion is receivable between the support bar and the upper horizontal segment of the bracket of the collars.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved foldable artificial Christmas tree which has all the advantages of the prior art artificial Christmas trees and none of the disadvantages.

It is another object of the present invention to provide a new and improved foldable artificial Christmas tree which may be easily and efficiently manufactured and marketed.

It is a further object of the present invention to provide a new and improved foldable artificial Christmas tree which is of durable and reliable construction.

An even further object of the present invention is to provide a new and improved foldable artificial Christmas tree which is susceptible of a low cost of manufacture with regard to both materials and labor, and which accordingly is then susceptible of low prices of sale to the consuming public, thereby making such a foldable artificial Christmas tree economically available to the buying public.

Even still another object of the present invention is to provide a new and improved foldable artificial Christmas tree for allowing for quick and easy assembly and disassembly.

Lastly, it is an object of the present invention to provide a new and improved foldable artificial Christmas tree including a plurality of sections couplable together to form a Christmas tree. Each of the sections includes a central pole portion. A plurality of collars are provided that each have a central opening for receiving the central pole section therein. Each of the collars has a generally circular configuration. The collars each have an outer periphery. Each of the collars has a plurality of radially extending apertures disposed within the outer periphery thereof in a spaced relationship. A plurality of branches are foldably coupled with the plurality of collars. Each of the branches has a limb portion. The limb portion has an inner portion and an outer portion. The outer portion has a plurality of artificial pine needles extending outwardly therefrom. The inner portion has a downwardly turned portion secured thereto. The downwardly turned portion is receivable within the radially extending apertures of the collars.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view of the present invention as taken along line 3—3 of FIG. 2.

FIG. 4 is a side view of one of the branches of the present invention.

The same reference numerals refer to the same parts through the various figures.

DESCRIPTION OF THE PREFERRED EMBODIMENT

Figure 2:
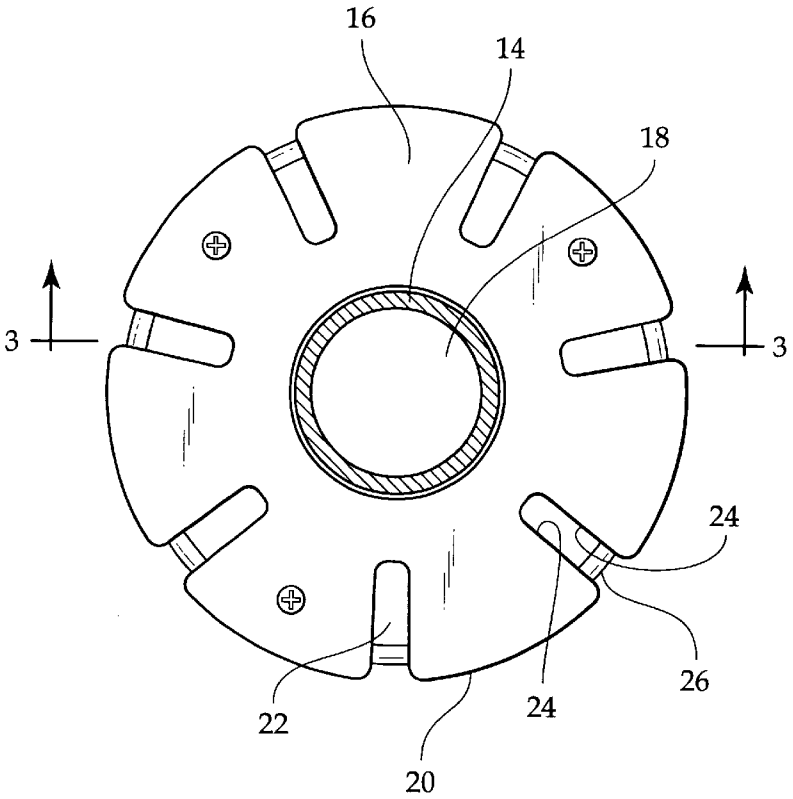
FIG. 2 is a top plan view of the present invention shown in cross-section.
Figure 1:
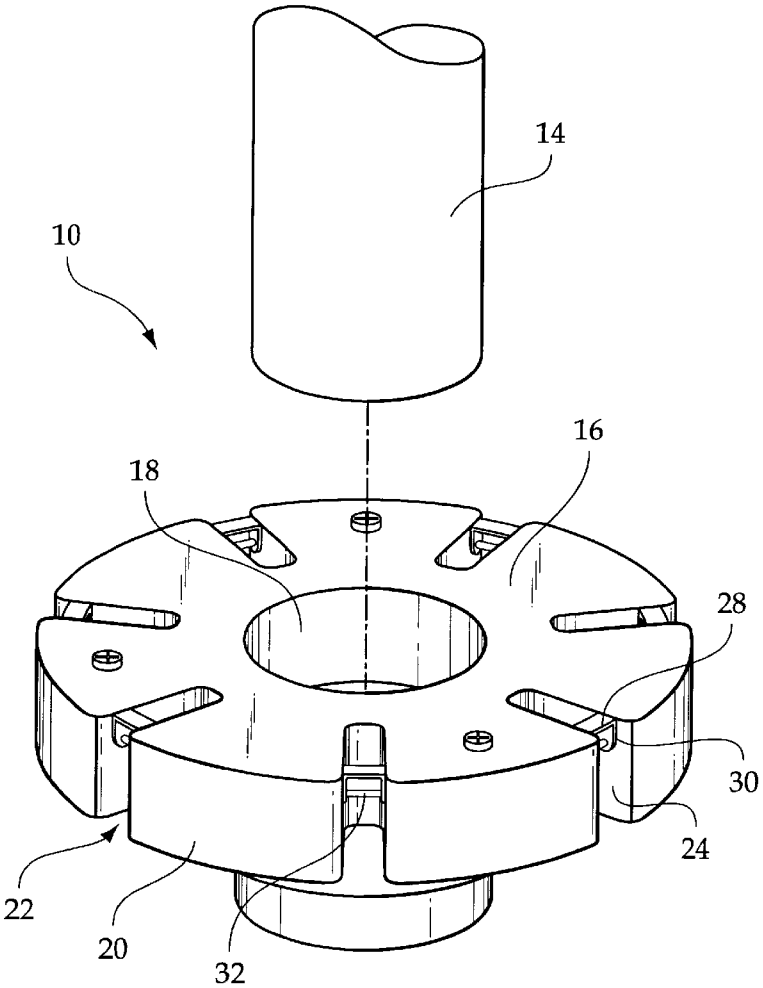
FIG. 1 is a perspective view of the preferred embodiment of the foldable artificial Christmas tree constructed in accordance with the principles of the present invention.
Figure 5:
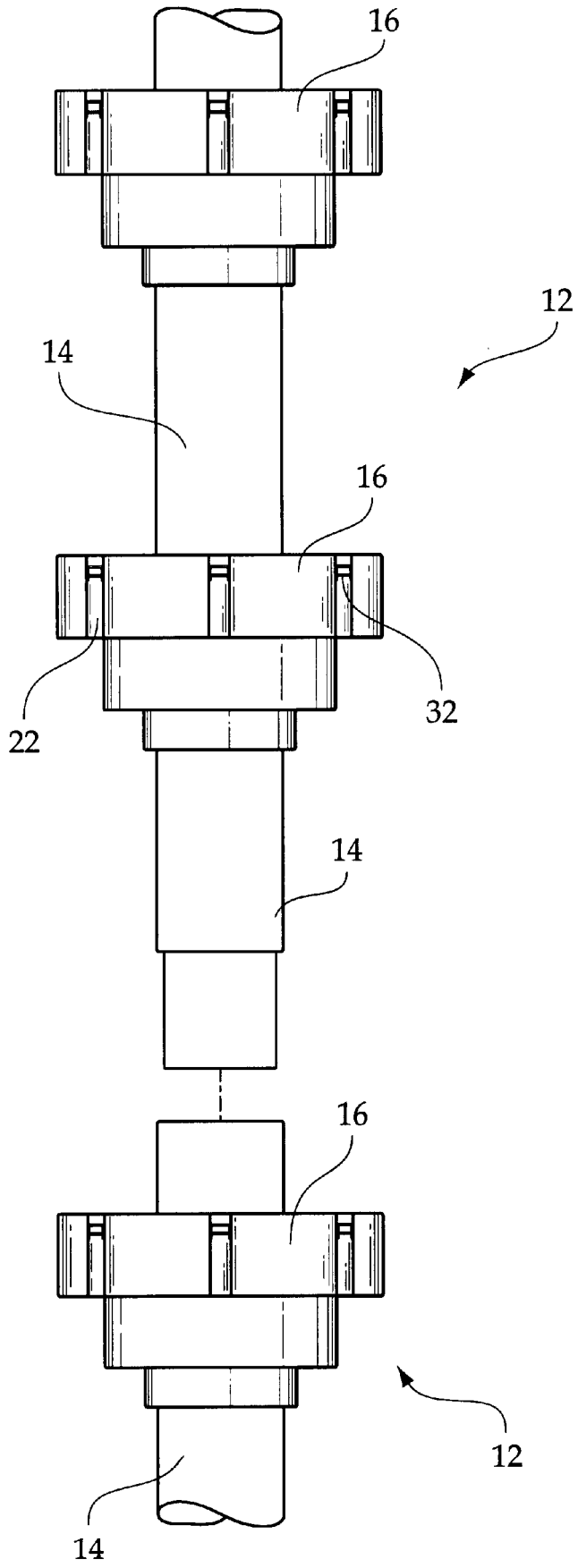
FIG. 5 is an exploded side view if the present invention illustrated in an assembling mode.

With reference now to the drawings, and in particular, to FIGS. 1 through 5 thereof, the preferred embodiment of the new and improved foldable artificial Christmas tree embodying the principles and concepts of the present invention and generally designated by the reference number 10 will be described.

Specifically, it will be noted in the various Figures that the device relates to a foldable artificial Christmas tree for allowing for quick and easy assembly and disassembly. In its broadest context, the device consists of a plurality of sections, a plurality of collars, and a plurality of branches. Such components are individually configured and correlated with respect to each other so as to attain the desired objective.

The plurality of sections 12 are couplable together to form a Christmas tree. Each of the sections 12 includes a central pole portion 14.

The plurality of collars 16 each have a central opening 18 for receiving the central pole portion 14 therein. Each of the collars 16 has a generally circular configuration. The collars 16 each have an outer periphery 20. Each of the collars 16 has a plurality of radially extending apertures 22 disposed within the outer periphery 20 thereof in a spaced relationship. Note FIGS. 1 and 2. Each of the radially extending apertures 22 has opposed side walls 24. The opposed side walls 24 have an inverted U-shaped bracket 26 secured therebetween. The bracket 26 includes an upper horizontal segment 28 and a pair of opposed vertical segments 30. The opposed vertical segments 30 have a support bar 32 extending therebetween whereby the support bar 32 is parallel with the upper horizontal segment 28.

The plurality of branches 34 are foldably coupled with the plurality of collars 16. Note FIG. 3. Each of the branches 34 has a limb portion 36. The limb portion 36 has an inner portion 38 and an outer portion 40. The outer portion 40 has a plurality of artificial pine 42 needles extending outwardly therefrom. The inner portion 38 has a downwardly turned portion 44 secured thereto. Note FIG. 4. The downwardly turned portion 44 is receivable between the support bar 32 and the upper horizontal segment 28 of the bracket 26 of the collars 16.

The present invention is constructed by securing the plurality of sections 12 together to form the Christmas tree. Note FIG. 5. The branches 34 are directed downwardly whereby the limbs 36 are horizontally oriented. When disassembling, the sections 12 are separated from one another and then inverted causing the branches to fall downwardly whereby the limbs 36 are essentially parallel to the central pole portion 14 for easy storage.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A foldable artificial Christmas tree for allowing for quick and easy assembly and disassembly comprising, in combination:

a plurality of sections couplable together to form a Christmas tree, each of the sections including:

a central pole portion;

a plurality of collars each having a central opening for receiving the central pole portion therein, each of the collars having a generally circular configuration, the collars each having an outer periphery, each of the collars having a plurality of radially extending apertures disposed within the outer periphery thereof in a spaced relationship, each of the radially extending apertures having opposed side walls, the opposed side walls having an inverted U-shaped bracket secured therebetween, the bracket including an upper horizontal segment and a pair of opposed vertical segments, the opposed vertical segments having a support bar extending therebetween whereby the support bar is parallel with the upper horizontal segment;

a plurality of branches foldably coupled with the plurality of collars, each of the branches having a limb portion, the limb portion having an inner portion and an outer portion, the outer portion having a plurality of artificial pine needles extending outwardly therefrom, the inner portion having a downwardly turned portion secured thereto, the downwardly turned portion being receivable between the support bar and the upper horizontal segment of the bracket of the collars.

* * * * *